United States Patent [19]

Garrard

[11] 4,313,897

[45] Feb. 2, 1982

[54] GAS AND LIQUID ADMIXING SYSTEM

[76] Inventor: Bruce Garrard, 126 Montgomery Ferry Dr. NE., Atlanta, Ga. 30309

[21] Appl. No.: 116,832

[22] Filed: Jan. 30, 1980

[51] Int. Cl.[3] ..... B01F 3/04

[52] U.S. Cl. ..... 261/64 D; 99/275; 99/323.1; 137/12.5; 137/404; 137/430; 222/57; 222/67; 222/129.1; 222/547; 261/121 R; 261/DIG. 7

[58] Field of Search ..... 261/62, 64 D, 70, 121 R, 261/DIG. 7; 99/275, 323.1; 222/56–58, 67, 129.1, 547; 137/12.5, 404, 430

[56] References Cited

U.S. PATENT DOCUMENTS

| | | | |
|---|---|---|---|
| 577,739 | 2/1897 | Frost et al. | 261/64 D X |
| 1,872,462 | 8/1932 | Johnson et al. | 261/DIG. 7 |
| 2,249,794 | 8/1941 | Sutton | 261/DIG. 7 |
| 2,748,076 | 5/1956 | Bohannon | 222/57 X |
| 2,809,597 | 10/1957 | Fowler | 261/DIG. 7 |
| 3,052,377 | 9/1962 | Bill | 261/DIG. 7 |
| 3,394,847 | 7/1968 | Garrard | 222/56 |
| 3,638,833 | 2/1972 | Lucas | 222/67 X |
| 3,746,323 | 7/1973 | Buffington | 261/122 |
| 4,174,743 | 11/1979 | Beny et al. | 222/56 X |
| 4,225,537 | 9/1980 | Martonffy | 261/70 |

*Primary Examiner*—Richard L. Chiesa

[57] ABSTRACT

Shown is a portable dispensing system schematically, with a motorless carbonator of the continuous flow type shown in detail employing a needle type valve that is removable as a unit for replacement or repair and which operates in combination with a float element in the carbonator to regulate flow of gas into the carbonator in a smooth manner that also induces a smooth and efficient flow of inlet water from a pressurized supply tank of water to equal the flow rate of carbonated water being drawn from the carbonator to serve one dispensing valve alone or two at a time.

7 Claims, 1 Drawing Figure

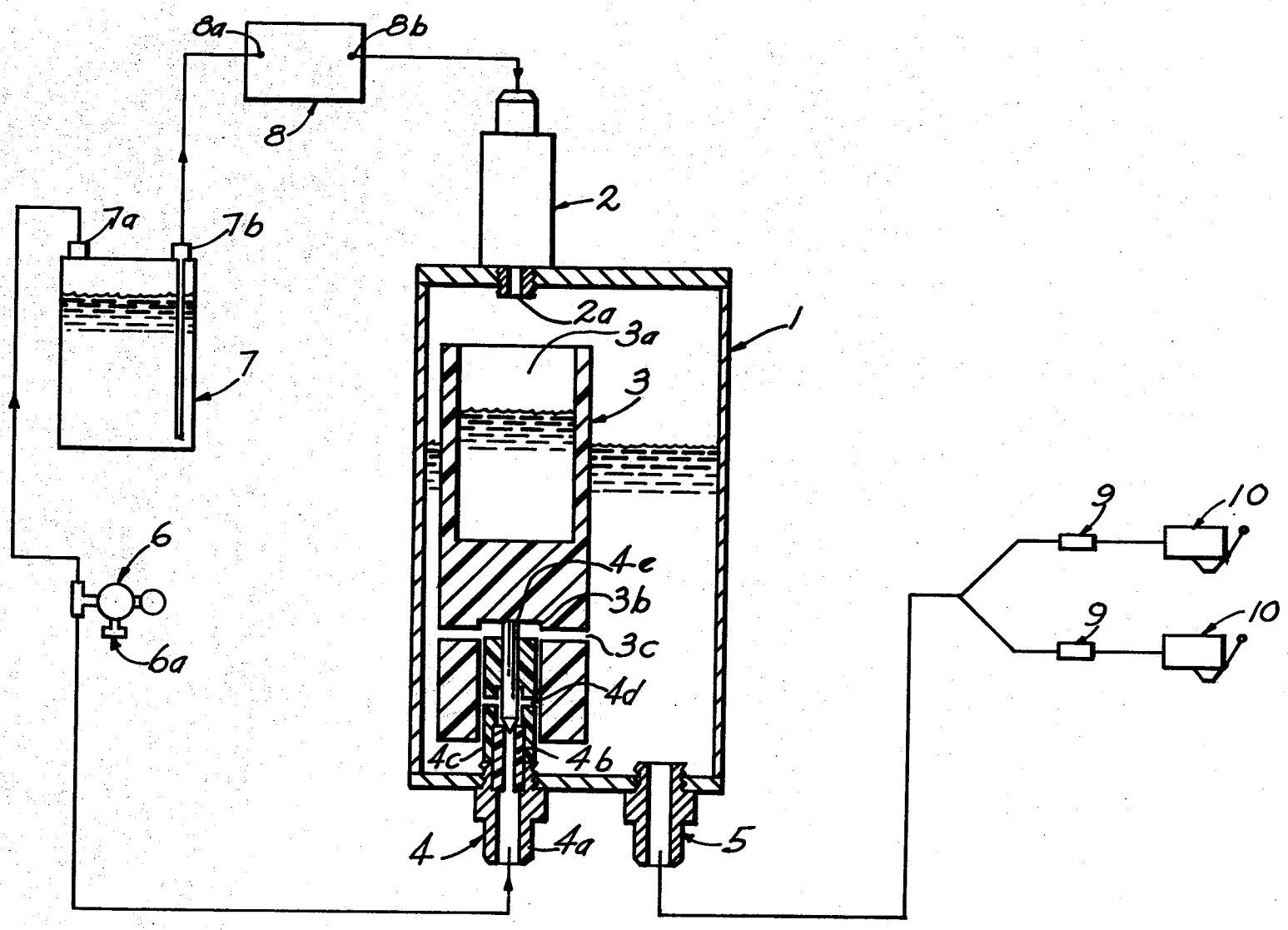
10
10
9
9
1
5
2
2a
3a
3
4e
3b
3c
4d
4b
4a
4c
4
8b
8
8a
7b
7
7a
6
6a

GAS AND LIQUID ADMIXING SYSTEM

SUMMARY AND BACKGROUND

This application discloses a gas and liquid admixing system commonly known as a motorless carbonator and is an outgrowth of my previous disclosures in U.S. Pat. No. 3,394,847 and a recently submitted application, Ser. No. 6/077,301, now U.S. Pat. No. 4,271,097 in the U.S. Patent Office, on similar devices. It particularly involves the use of an improved design of gas inlet valve employing an arrangement known as a needle valve which has been found to have important advantages in durability and the ability to withstand adverse conditions of shipping and use as well as being of a construction that makes removal and replacement as a complete unit possible. In addition, it was fortunately found to have important features from a performance standpoint compared with the rubber seat and inlet tube arrangement shown in my previous disclosures.

In particular, the rubber seat arrangement was found to be vulnerable to damage in shipping and sometimes in actual use when water was not present in the carbonator to support the float. In some cases of shipping the rubber seat could be, and was, badly damaged by the repeated bouncing of the float and rubber seat on top of the relatively sharp open end on top of the inlet tube, especially if the carbonator happened to be shipped in a vertical position, which could not be controlled. Similarly, in actual use on a catering truck, for example, if all water had been drained from the unit a similar situation resulted when the truck was driven appreciable distances, causing similar damage to the rubber seat and requiring replacement. Under normal operating conditions the rubber seat had a long life since water was present to support much of the float weight or to dampen any bouncing that might occur.

The needle valve design shown in this disclosure has eliminated these problems since the stainless steel needle and nylon orifice which are used in the preferred design have proved to be fully capable of withstanding considerable use or abuse under such adverse conditions and have been found to be virtually trouble free. In addition, the tapered design of the needle, together with other features of the design, has been found to provide a smoother flow of gas than was provided by the rubber seat arrangement, and the smoother control of water flow into the carbonator that accompanies the smoother control of gas flow has led to increased efficiency of the unit. As a result, the simplicity of a single water inlet with a simple orifice directing full flow into the float mixing chamber has been found applicable, in combination with the needle valve design, to accommodate a single or double flow rate of carbonated water to serve one dispensing valve or two at a time.

It has also been found to be applicable to the designs shown in my recent disclosure mentioned above, Ser. No. 6/077,301, showing vertical and horizontal designs with pivoted and non-pivoted floats and with single or double water inlets using single jet orifices or combination jet and spray orifices. In these cases the smoother flow of water and gas and the freedom from damage under adverse conditions add appreciably to the utility and performance of the designs, while providing a gas inlet valve that is easier to replace, repair or inspect.

The detailed description that follows will further clarify the nature of the invention and its various advantages and applications.

BRIEF DESCRIPTION OF THE DRAWING

The drawing shows a vertical section of a carbonator tank and its working parts, including the gas inlet valve. In addition a recommended dispensing system is shown in schematic form in relation to the carbonator and gas inlet valve, to facilitate an understanding of the practical use of the invention.

DESCRIPTION OF THE PREFERRED EMBODIMENT

Referring again to the drawing, the carbonator 1 is shown connected in schematic representation to a preferred dispensing system, including water supply tank 7, cold plate 8, two flow regulators 9 and two dispensing valves 10. A pressure regulator 6, which is understood to be connected to a supply of carbon dioxide gas at *6a*, supplies gas at approximately 90 to 100 psi to the water tank 7 at fitting *7a* and to the carbonator gas inlet valve at fitting *4a*. Water is supplied to the water inlet 2 from water tank 7 through the outlet fitting *7b*, then through the fittings *8a* and *8b* on cold plate 8. Outlet fitting 5 at the bottom of carbonator 1 supplies carbonated water to flow regulators 9 and dispensing valves 10. The flow regulators may be an integral part of the dispensing valve in some cases and serve to maintain a constant flow rate to each valve regardless of some variation of pressure in the carbonator, especially a lower pressure when two valves are being served at one time as compared with the pressure when only one is being served.

The float 3 is preferably made of polyethylene or polypropylene or a similar material equally impervious to carbonated water and having a specific gravity somewhat less than water or near that of water. A mixing well *3a* in the top of the float receives water from orifice *2a* in the bottom of water inlet 2, preferably a check valve, and mixes it with gas, the mixture overflowing into the tank. A recess in the bottom of the float member accommodates the gas inlet valve 4 with clearance, and drilled passageway *3c* in the side wall of the float connects recess *3b* with the main area of the carbonator tank. Gas inlet valve 4 comprises a fitting *4a*, plastic sleeve *4c*, preferably Teflon, orifice member *4b*, preferably Nylon, and needle *4e*, preferably stainless steel. The orifice member *4b* is pressed into a bore in the top end of fitting *4a* with a portion extending above the fitting and onto which sleeve *4c* is pressed. For functional purposes this combination can be considered as one unit. The needle *4e* operates freely in a bore in the top of sleeve *4c*, the bottom end of the needle being tapered and in contact with the top of the orifice in member *4b* and the upper end of the needle being in contact with the float at the upper end of recess *3b*. A drilled passageway *4d* in sleeve *4c* permits inlet gas to flow into recess *3b* and passageway *3c* directs the flow into the tank, at a point sufficiently above soda outlet 5 to eliminate gas being drawn directly into the outgoing water and gas mixture. The extension of float 3 below passageway *4d* prevents gas from going directly from passageway *4d* to outlet 5.

It will be noted that the gas inlet valve 4 can be easily removed as a complete unit, including the needle, by unscrewing fitting *4a* while holding the carbonator in a vertical position. The entire unit can be easily inspected and repaired by replacement of parts or assemblies and easily reinstalled. Usually this will mean replacement individually of the needle as one main component, or of the housing assembly comprising fitting, orifice, and sleeve as the other main component. In addition, the sleeve is easily removed and can be replaced individually as can the combination orifice and fitting. Usually the latter combination would not be separated further into orifice and fitting except at a factory or service center.

Functionally, the system operates as follows. The liquid level in the carbonator is shown as it exists with no dispensing valve open, the float 3 being supported by its displacement of liquid and exerting virtually no downward force on needle 4*e*. With no restriction of gas into the carbonator the pressures in the carbonator and in water tank 7 are equal to the gas supply pressure and to each other, resulting in no flow of gas or water into the carbonator. The liquid level in well 3*a* is the residue from the bubbly mixture of gas and water that existed during a previous draw cycle and filled the well to overflowing.

When a dispensing valve 10 opens, carbonated water is drawn from carbonator 1 through outlet 5 and flow regulator 9 at a chosen rate of perhaps 1¼ ounces per second, a flow rate common in the industry. The level of mixture in the carbonator momentarily drops, creating a void that lowers the pressure in the carbonator below the gas supply and water supply pressure and induces flow of gas and water into the carbonator through gas inlet valve 4 and water inlet check valve 2. The rate of each is governed automatically by the relation of the gas inlet valve to the float and by the relative sizes of the water and gas orifices. As the water level falls, more and more float weight bears on needle 4*e*, increasing the restriction of gas entering. Also, the jet force of water entering mixing well 3*a* generates a downward force on needle 4*e*, further restricting gas flow. Since gas restriction during a draw will encourage greater water flow into the carbonator, the water level will fall only to the point where the gas restriction is sufficient to cause the rate of water entering to equal that of liquid leaving the carbonator, and causing the water level to stabilize at an intermediate point on the float. If water enters too fast the level will rise, reducing the gas restriction and allowing more gas to enter, thus reducing the rate of entering water to equal the rate of mixture leaving. Consequently, the needle type gas inlet valve can be seen to operate in combination with the float and the water inlet orifice to meter gas directly and water indirectly in the exact proportions to each other and in the correct total amount to maintain a constant flow of mixture to the dispensing valve or valves and a steady level of mixture at an intermediate point on the float.

Somewhat unexpectedly, a combination of gas and water orifice sizes was found that apparently results in the flow of inlet water furnishing the almost exact degree of gas restriction required for that rate of water flow, so that the water level was found to operate near the level shown, where the net weight of the float bearing on the needle is virtually zero and the entire force on the needle during a draw must be attributed to the jet force of the inlet water. When a second valve 10 is opened in addition to the first one, giving a total flow rate of 2½ ounces per second, the water level remains virtually constant at the same point, indicating the additional force downward on the needle due to the increased jet force of entering water increases the gas restriction the exact amount needed to maintain the higher flow rate of water and gas in the right proportion and amount with virtually no change in force due to a change in float weight caused by a water level change.

When outlet flow stops, by closing the dispensing valves, the carbonator pressure quickly equalizes to the supply pressure of gas and water, stopping the flow of both almost instantaneously, with the water level remaining at the point shown, ready for another cycle.

The combination of orifice sizes that has proved to be so advantageous involves a ratio of approximately two to one in orifice area or seven to five in diameter of water orifice to gas orifice. For example, an orifice size of 7/64 inches for water and 5/64 inches for gas were found to perform as described and to provide the accurate control at two flow rates, one twice the other, in a carbonator with the simplicity of design shown.

An important feature to note in the drawing is the fact that there is no tendency of incoming gas, once the needle opens, to act on any area with a significant upward force that would tend to open the needle further and cause an uncontrolled volume of gas to enter suddenly. With the rubber seat and inlet tube arrangement such a problem has been noted, causing uneven flow of entering water and a reduction in efficiency relative to the degree of carbonation obtainable at a given pressure and the amount of gas consumption per tank of water. This can perhaps be understood by noting that entering gas has a velocity head as it leaves the inlet tube, and the rubber seat, being normal to this flow, is acted on directly by the resultant force, tending to open the valve wider and let in gas unevenly. In the needle design any significant upward velocity head of entering gas that leaves the gas orifice is absorbed by the upper end of the counterbore in sleeve 4*c* connecting with hole 4*d*, with no tendency to open the needle further.

I claim:

1. A system for carbonating water concurrently with carbonated water being drawn from the system, comprising a carbonating tank, a water supply source connected to said tank, a gas supply source connected to said tank, and drawing means connected to said tank for dispensing carbonated water, a float member within said tank responsive to the level of liquid in the tank, a gas inlet valve connected to said gas source and mounted in a wall of said tank, mechanical connection means within said tank connecting said float member with said gas inlet valve, said valve including a needle member and an orifice member, a decrease in said liquid level providing a gravitational force on said float member, said connection means conveying said force from said float member to said needle member to bias said needle member against said orifice member increasingly with a falling level of said liquid, thereby reducing the flow rate of gas into the tank as the liquid level falls and increasing it as the liquid level rises, a flow of water being induced into the tank during a draw of liquid from the tank which increases with a reduction of liquid level in the tank and decreased gas flow into the tank, said water flow decreasing with a rising liquid level and increased gas flow rate into the tank, an equilibrium point being reached at an intermediate level of liquid in the tank, with the liquid at an intermediate point on the float member, wherein the inlet flow rates of gas and water are continuously controlled to substantially equal the outlet flow rates of gas and water contained in the departing mixture of carbonated water, thus maintaining the liquid level at a constant point in the tank and at a constant level on the float member during a draw of carbonated water at a constant rate, and maintaining a constant and even mixing of gas and water as they enter the tank with constant flow rates and under constant conditions of gas pressure in the tank, during said draw.

2. A system as in claim 1 in which said needle has a constant bias toward contact with said orifice and functions in combination with the orifice as a check valve to prevent the back flow of water into the gas inlet fitting and into the connecting means therefrom to said gas source.

3. A system as in claim 1 in which at least a portion of said inlet water impacts on said float member and a force due to said impact is transmitted through said connection means to bias said needle member against said orifice, the inlet flow rate of gas being reduced by an increase in said impact force.

4. A system as in claim 3 in which said impact force controls the flow rates of inlet gas and water to substantially equal the flow rates of outlet gas and water included in the liquid mixture of gas and water being drawn, the force due to float weight being minimal, with the liquid level remaining at or near a neutral point on the float where the net weight of the float transmitted to the needle would be zero except for the force due to the impact of inlet water on the float.

5. A system as in claim 4 in which mixture at a second flow rate may be drawn from the tank at twice the flow rate of a first flow rate, with the level of mixture in the tank remaining substantially constant at both flow rates, the increased impact on the float due to the increased velocity and flow rate of inlet water at the higher flow rate producing substantially the amount of increase of force on the needle required to correctly control the flow rate of inlet gas directly and to correctly control the inlet flow rate of water through the correct control of inlet gas flow.

6. A system as in claim 1 in which said gas inlet valve is further comprised of a sleeve member having a bore aligned with said orifice member and receiving said needle in free sliding relationship, said sleeve having a chamber proximate to the tapered end of the needle and receiving inlet gas from said orifice and absorbing any component of velocity head force of said gas that tends to move the needle toward a wider open position relative to the orifice, preventing over response of the needle due to such force and preventing uneven surges in the flow of inlet gas that would in turn cause uneven flow of inlet water and reduced efficiency of mixing of the inlet gas and water.

7. A system as in claim 6 in which said needle type valve further comprises a removable inlet fitting in combination with said orifice member, sleeve member and needle to form an assembly that is externally removable from, and externally replaceable in, a wall of said tank while said wall remains a rigid portion of said tank.

* * * * *